US006319082B1

(12) United States Patent
Hirano et al.

(10) Patent No.: US 6,319,082 B1
(45) Date of Patent: Nov. 20, 2001

(54) METHOD OF MAKING AN ELECTRON EMISSION DEVICE BY ANODE OXIDATION

(75) Inventors: Takashi Hirano, Kanagawa; Masami Okita, Tokyo, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/246,579

(22) Filed: Feb. 8, 1999

(30) Foreign Application Priority Data

Feb. 17, 1998 (JP) ..... 10-034856

(51) Int. Cl.[7] ..... H01J 9/00
(52) U.S. Cl. ..... 445/24; 445/49
(58) Field of Search ..... 445/24, 49, 50; 313/309, 336

(56) References Cited

U.S. PATENT DOCUMENTS 5,564,959 10/1996 Spindt et al. ..... 445/24
6,039,621 * 3/2000 Chakravorty et al. ..... 445/49

FOREIGN PATENT DOCUMENTS

96/06443 2/1996 (WO) .

* cited by examiner

*Primary Examiner*—Nimeshkumar D. Patel
*Assistant Examiner*—Todd Reed Hopper
(74) *Attorney, Agent, or Firm*—Ronald P. Kananen; Rader, Fishman & Grauer

(57) ABSTRACT

The present invention provides an electron emission device production method for producing an electron emission device exhibiting a preferable electron emission characteristic with a low voltage and an emitter electrode of a highly accurate configuration at a highly accurate position.

A conductive layer is formed via an insulation layer on a cathode electrode. A first opening is formed in this conductive layer and a second opening is formed to communicate with the first opening so as to expose the cathode electrode. An emitter electrode is formed on the cathode electrode exposed from the second opening. On the conductive layer, a porous layer having a plurality of holes in the film thickness direction is formed so as to be used as a mask when forming the first opening in the conductive layer.

22 Claims, 8 Drawing Sheets

METHOD OF MAKING AN ELECTRON EMISSION DEVICE BY ANODE OXIDATION

BACKGROUND OF THE INVENTION

1. Field of the Invention

The present invention relates to an electron emission device production method for an electron emission device having an emitter electrode for field electron emission.

2. Description of the Prior Art

Recently, development of display apparatuses has been directed to make the apparatuses thinner. In such a circumstance, special attention is paid to a so-called field emission type display (hereinafter, referred to as FED) constituted by electron emission devices.

In an FED, for each pixel, there is provided an electron emission device in combination with an anode electrode and a fluorescent body arranged to opposite to this electron emission device. A plurality of such pixels are formed in a matrix to constitute a display. In this FED, an electron emitted from the electron emission device is accelerated by an electric field between the electron emission device and the anode electrode so as to strike the fluorescent body. Thus, in the FED, the fluorescent body is excited to emit light to display an image.

In general, the electron emission apparatus is a spindt type electrom emission device. As shown in FIG. 1 the spindt type electron emission device includes; a cathode electrode 100, a gate electrode 102 layered on an insulation layer 101 on the cathode electrode 100, and an emitter electrode 104 having an approximately concial shape formed in an opening 103 formed in the insulation layer 101 and the gate electrode 102 so as to expose the cathode electrode 100. In this electron emission apparatus, the emitter electrode 104 is formed so that its vertex matches with the center line of the opening 103. In the FED, a plurality of the spindt type electron emission devices are arranged corresponding to respective pixels.

In the electron emission device having such configuration, a positive potential is applied to the gate electrode 102, whereas a negative potential is applied to the cathode electrode 100, so as to generate an electric field between the gate electrode 102 and the cathode electrode 100. This electric field is applied to the tip end of the emitter electrode 104, so that an electron is emitted from the tip end of the emitter electrode 104. As has been described above, this causes the fluorescent body to emit light.

When producing such an electron emission device, firstly, the cathode electrode 100 is formed on a substrate, and then the gate electrode 102 is formed over the insulation layer 101 on the cathode electrode 100. The aforementioned opening 103 is formed by way of photo-lithographic technique.

This opening 103 is, for example, formed as follows. A mask layer having a plurality of openings is formed on the gate electrode 102. Etching is carried out on the mask layer together with the gate electrode 102 exposed by these openings, so that the openings are transferred to the gate electrode 102 and the insulation layer 101. Thus, by transferring the openings formed on the mask layer, it is possible to form an opening 103 communicating with the gate electrode 102 and the insulation layer 101.

After this, a conductive material is sputtered from various directions onto the gate electrode 102, so as to form the conical emitter electrode 104 inside the opening 103. Then, the conductive material sputtered onto the gate electrode 102 is removed, thus obtaining the aforementioned spindt type electron emission device.

In such a spindt type electron emission device, it is possible to effectively emit electrons by concentrating an electric field to the tip end of the emitter electrode 104. In other words, in the spindt type electron emission device, in order improve the electron emission characteristic, it is necessary to concentrate the electric field at the tip end of the emitter electrode 104. This is achieved by reducing the dimension of the opening formed in the gate electrode 102.

However, in the FED using the spindt type electron emission device, it is generally impossible to obtain a uniform electron emission characteristic between pixels. Because the luminance varies depending on respective pisels, it is difficult to display a clear image. Accordingly, in the FED using the spindt type electron emission device, in order to obtain a preferable image, it is necessary to take additional care to provide a uniform electron emission characteristic over the entire screen. This result can be obtained by uniformly forming the openings of the electron emission device constituting the pixels and by assuring to a strictly conical shape for the emitter electrode 104.

In the production method of the aforementioned spindt type electron emission device, when forming the opening 103 in the gate electrode 102 and the insulation layer 101, a photo-resist is used as the sacrifice layer. In this case, the photo-resist is partially exposed to light so as to form the opening in the sacrifice layer.

In this method, however, there is an optical limit in the diameter of the opening that can be formed on the photo-resist. That is, the possible diameter is on the order of 0.2 to 0.3 micrometers. Because of this limit of the dimension of the opening 103 formed in the gate electrode 102, this method cannot produce an electron emission device having a sufficient electron emission characteristic. If the dimension of the opening 103 is too large and the electron emission characteristic is insufficient, it is necessary to apply a great voltage to the gate electrode 102.

Moreover, U.S. Pat. No. 5,564,959 discloses a method for reducing the dimension of the opening formed in the mask layer. That is, an organic high molecule is used for the mask layer, to which accelerated particles such as ions are radiated so as to form a circular opening with a predetermined density. This method enables the formation of an opening having a diameter of 0.2 micrometers or less;

However, this method cannot form an opening at a predetermined position. In other words the positional accuracy of the opening is extremely low. That is, in this method, two or more openings may be overlapped. In such a case, it is difficult to uniformly form the emitter electrode. According to the method disclosed in this U.S. Pat. No. 5,564,959 it is difficult to produce an electron emission device having a uniform electron emission characteristic over a wide area.

Furthermore, PCT International Publication WO96/06443 discloses another method for reducing the dimension of the opening formed in the mask layer. That is, an insulator having a porous structure is used as the insulation layer, and an emitter electrode is formed within the porous structure of this insulation layer. A gate electrode is then formed on the porous insulation layer. By this method, it is possible to form an opening having a dimension of 0.2 micrometers or less.

In this method, however, the gate electrode is formed by deposition on the porous insulation layer and there is a chance that the conductive material constituting the gate electrode will adhere inside this porous structure. In this case, the electron emission device causes a short-circuit between the conductive material and the emitter electrode. Moreover, the wall of the porous structure may be subjected to etching so as to remove the conductive material adhered to the porous structure. However, it is difficult to completely removed the conductive material by this method to prevent the aforementioned short-circuit.

SUMMARY OF THE INVENTION

It is therefore an object of the present invention to provide an electron emission device production method for obtaining a preferable electron emission characteristic with a low voltage and for significantly increasing the positional accuracy of the emitter electrode.

The electron emission device production method according to the present invention includes steps of: forming a conductive layer on an insulation layer on a cathode electrode; forming a first opening in the conductive layer; forming a second opening to communicate with the first opening so as to expose the cathode electrode; and forming an emitter electrode on the cathode electrode exposed from the second opening; wherein a porous layer having a plurality of holes in a film thickness direction is formed on the conductive layer, so as to be used as a mask when forming the first opening.

In the electron emission device production method having the aforementioned configuration, the porous layer is used as a mask to form holes in the conductive layer immediately below the plurality of holes formed in the porous layer, thus obtaining the first openings. In this method, it is possible to form the first openings with a size corresponding to the dimensions of the plurality of holes formed in the porous layer. Moreover, in this method, it is possible to form the first openings with a positional accuracy corresponding to the positional accuracy of the holes formed in the porous layer.

The electron emission device production method according to the present invention may such that the porous layer is formed by anode oxidation of a conductive film.

In this case, the porous layer is formed by anode oxidation and accordingly a number of holes formed in the porous layer have a preferable positional accuracy and each has a very small opening dimension. Accordingly, in this method, it is possible to form the first openings with a preferable positional accuracy as well as a very small opening dimension.

According to another aspect of the present invention, there is provided an electron emission device production method including the steps of: forming a conductive layer on an insulation layer on a cathode electrode; forming a first opening in the conductive layer; forming a second opening to communicate with the first opening so as to expose the cathode electrode; and forming an emitter electrode on the cathode electrode exposed from the second opening; wherein the conductive layer is subjected to anode oxidation so as to make porous a surface portion of the conductive layer in a thickness direction, so that the porous layer is used as a mask for forming the first opening in a thickness direction of the conductive layer.

In the electron emission device production method having the aforementioned configuration according to the present invention, a surface portion of the conductive layer is made a porous layer, which is used as a mask for forming the first openings. In other words, this method does not require a step of forming a particular layer to serve as a mask, thus simplifying the production procedure.

DETAILED DESCRIPTION OF PREFERRED EMBODIMENTS

Hereinafter, a description will be made of an electron emission device production method according to preferred embodiments of the present invention with reference to the attached drawings.

Firstly, explanation will be made of an electron emission device produced by this method with reference to FIG. 2 and FIG. 3.

Figure 1:
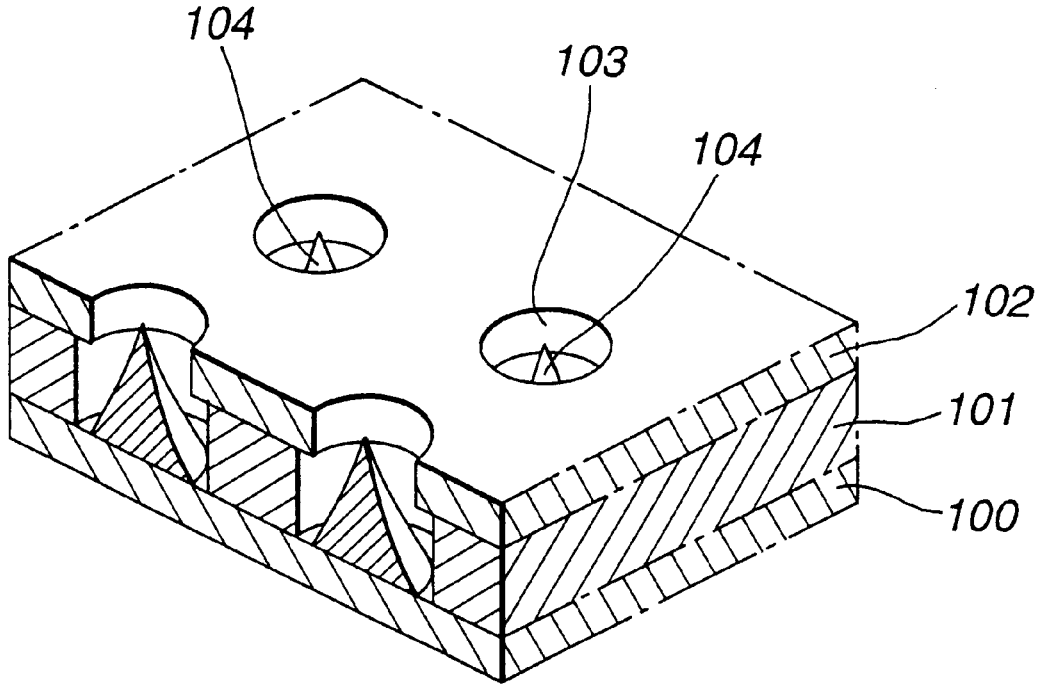
FIG. 1 is a cross sectional view showing an essential portion of a conventional electron emission device.
Figure 2:
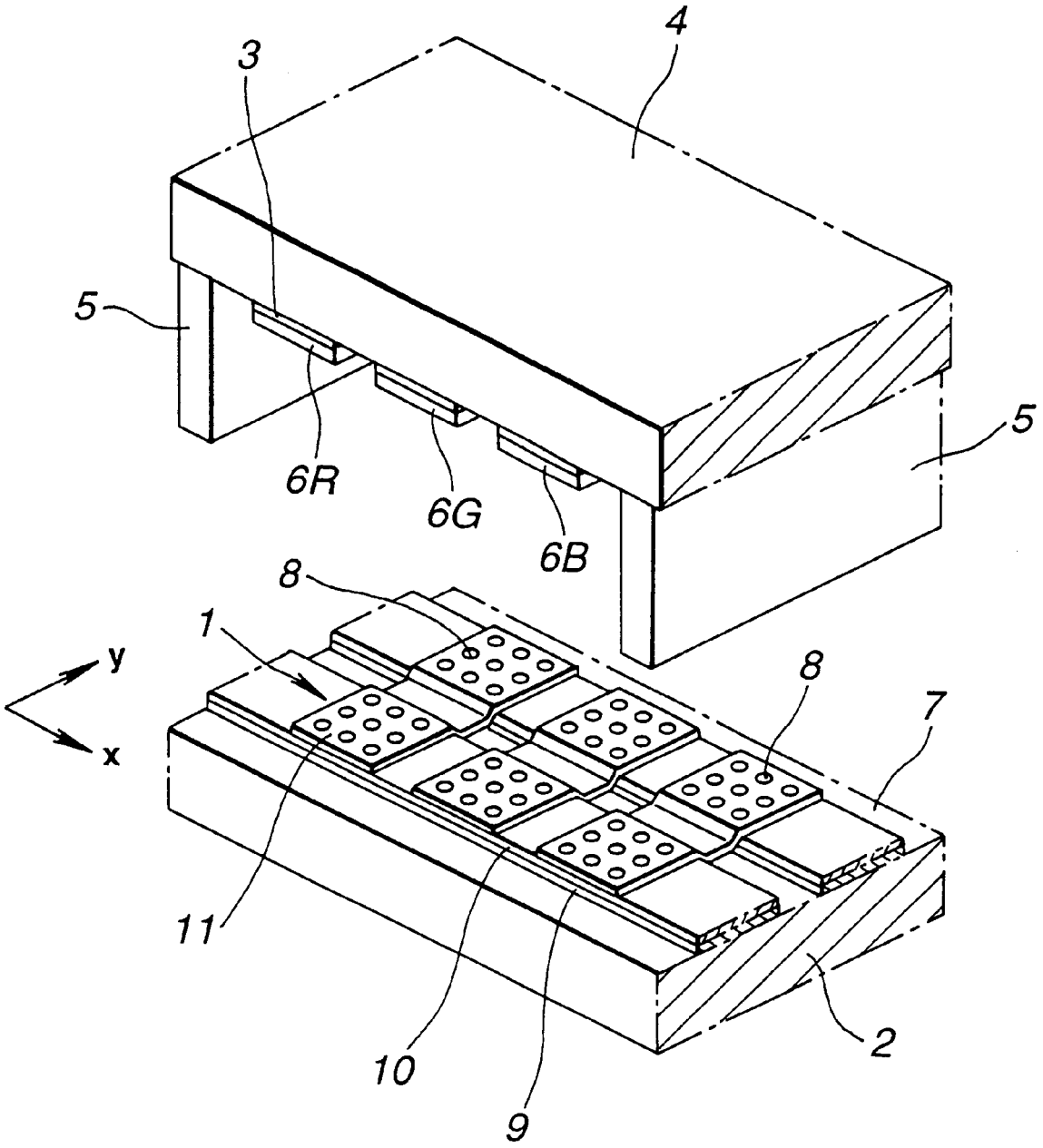
FIG. 2 is a perspective view schematically showing an FED configuration using an electron emission device according to the present invention.

FIG. 2 shows a field emission type image display apparatus (hereinafter, referred to as FED) using the electron emission device 1 shown in FIG. 3 produced by the method of the present invention. The FED includes: a back plate 2 on which the electron emission device 1 is formed for field electron emission; a face plate 4 on which an anode electrode 3 is formed in stripes opposite to the back plate 2; and a pillar 5 arranged between the back plate 2 and the face plate 4. In this FED, the space between the back plate 2 and the face plate 4 is maintained in a high vacuum.

In this FED, on the face plate 4, fluorescent bodies are arranged as follows. A red fluorescent body 6R for emitting a red light is formed on a predetermined anode electrode 3, a green fluorescent body 6G for emitting a green light is formed on an adjacent anode electrode 3, and a blue fluorescent body 6B for emitting a blue light is formed on an adjacent anode electrode 3. That is, on this face plate 4, a plurality of red fluorescent bodies 6R, green fluorescent bodies 6G, and blue fluorescent bodies 6B (hereinafter, they will be referred to as fluorescent bodies 6 in general) are formed alternately in stripes.

Moreover, in this FED, as shown in FIG. 2, the electron emission device 1 is arranged in a matrix on the insulation substrate 7. These electron emission devices 1 have a plurality of openings 8 formed in the direction of the layered configuration, so that electrons are emitted through these openings. In this FED, the electron emission devices 1 are arranged at positions opposite to the red fluorescent bodies 6R, the green fluorescent bodies 6G, and the blue fluorescent bodies 6B.

In this FED, those regions of the red fluorescent body 6R, the green fluorescent body 6G, and the blue fluorescent body 6B which oppose to the electron emission device 1 constitute a pixel. It should be noted that a plurality of electron emission devices 1 may oppose a fluorescent body 6 constituting a pixel.

Figure 3:
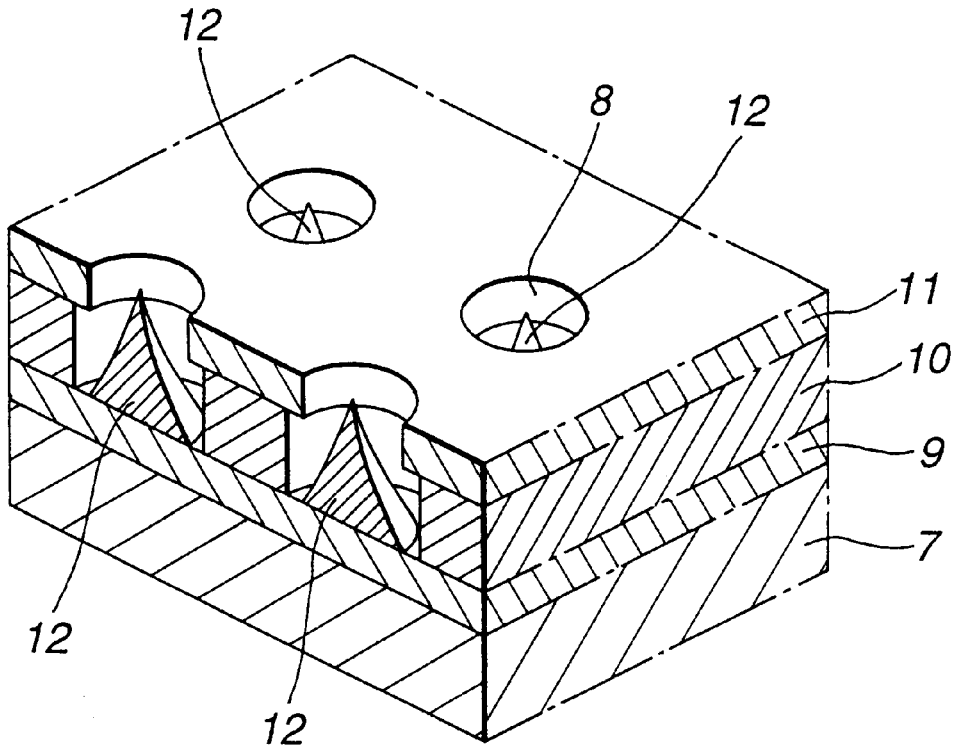
FIG. 3 is a schematic perspective view for explanation of a configuration of the electron emission device according to the present invention.

As shown in FIG. 2 and FIG. 3, the electron emission device includes: an insulation substrate 7 such as a glass; a cathode electrode 9 arranged on this insulation substrate 7 in a direction vertically intersecting the fluorescent bodies 6; an insulation layer 10 formed on this cathode electrode 9; a gate electrode 11 arranged on the insulation substrate 7 and the insulation layer 10 in a direction parallel to and opposing the fluorescent body 5; an opening 8 communication between the gate electrode 11 and the insulation layer 10 where the cathode electrode 9 is exposed; and an emitter electrode 12 formed on the exposed cathode electrode 9 within the opening 8.

In this electron emission device 1, the emitter electrode 12, as will be detailed later, is formed approximately as a conical shape having a bottom in contact with the cathode electrode 9. In this emitter electrode 12, its tip end is positioned approximately at the center of the opening 8 formed in the gate electrode 11. Moreover, the opening is formed so as to have a porous structure and to be arranged regularly through a production procedure that will be detailed later.

The electron emission device production method according to the present invention is applied when producing the aforementioned electron emission device 1.

Figure 4:
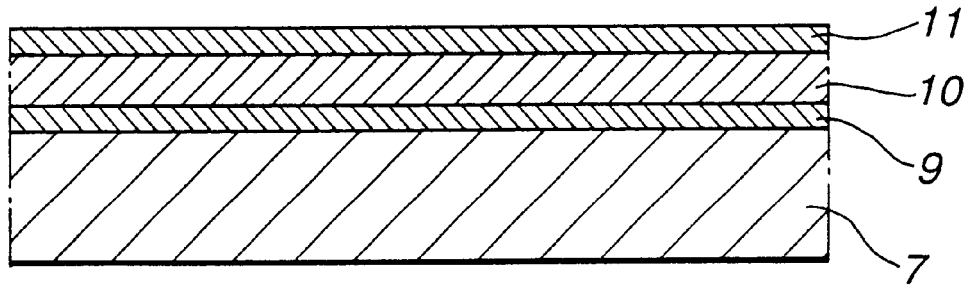
FIG. 4 is a cross sectional view showing a portion of the electron emission device including an insulation substrate on which a cathode electrode, an insulation layer, and a gate electrode are formed by the electron emission device production method according to the present invention.

Firstly, as shown in FIG. 4, an insulation substrate 7 such as glass is prepared. On this insulation substrate 7, a plurality of cathode electrodes 9 are formed parallel to a predetermined direction. Over these cathode electrodes 9, the insulation layer 10 is formed. On the insulation substrate and the insulation layer 10, the gate electrode 11 is formed in a direction vertically intersecting the cathode electrodes 9. More specifically, the cathode electrode 9 is formed with a thickness of about 0.1 micrometers; the insulation layer 10 is formed with a thickness of about 0.2 micrometers; and the gate electrode 11 is formed with a thickness of about 0.1 micrometers.

Here, the insulation substrate preferably has a main surface smooth and flat made from, for example, glass or silicon.

Moreover, the cathode electrodes formed on the insulation substrate should have a preferable conductivity, a preferable contact with the insulation layer 10 formed on the insulation substrate 7 and the upper layer 10 as well as an etching selection characteristic which is substantially less than that of with the insulation material constituting the insulation layer 10. Considering these characteristics, the cathode electrodes 9 are preferably made from a conductive material having a low reactivity such as chrome (Cr), gold (Au), or platinum (Pt).

Furthermore, the insulation layer formed on the cathode electrodes 9 should have a preferable insulation characteristic and a rapid etching speed compared to the cathode electrodes 9. Considering these characteristics, the insulation layer 10 is preferably made from, for example, an insulation material such as silicon dioxide.

Furthermore, the gate electrode 11 formed on the insulation layer 10 should have a preferable conductivity and a preferable corrosion resistance. Considering these characteristics, the gate electrode 11 is preferably made from a conductive material having a low reaction characteristic such as gold (Au) or platinum (Pt).

Figure 5:
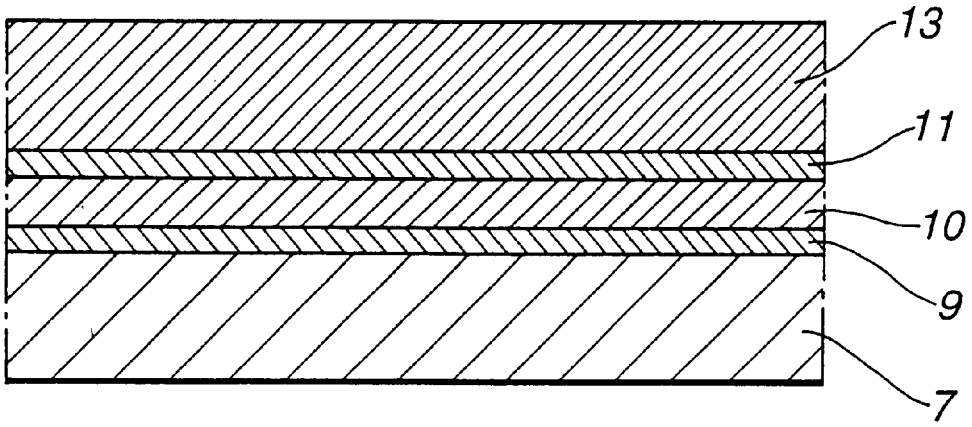
FIG. 5 is a cross sectional view showing a portion containing a conductive film formed by the electron emission device production method according to the present invention.

Next, as shown in FIG. 5, a conductive film 13 is formed on the gate electrodes 11 by way of a physical thin-film formation method such as the sputtering method. This conductive film 13 is made from a material having an electrical conductivity and capable of anode oxidization such as aluminium (Al), titanium (Ti), or ziroconium (Zr).

Here, the conductive film 13 may be formed over the entire surface of the insulation 7 substrate, i.e., on the exposed insulation substrate, the insulation layer 10, and the gate electrode 11, or only at the intersections of the cathode electrode with the gate electrode 11.

Moreover, more specifically, the conductive film 13 is preferably an aluminium film having a thickness of about 1.0 micrometer.

Figure 6:
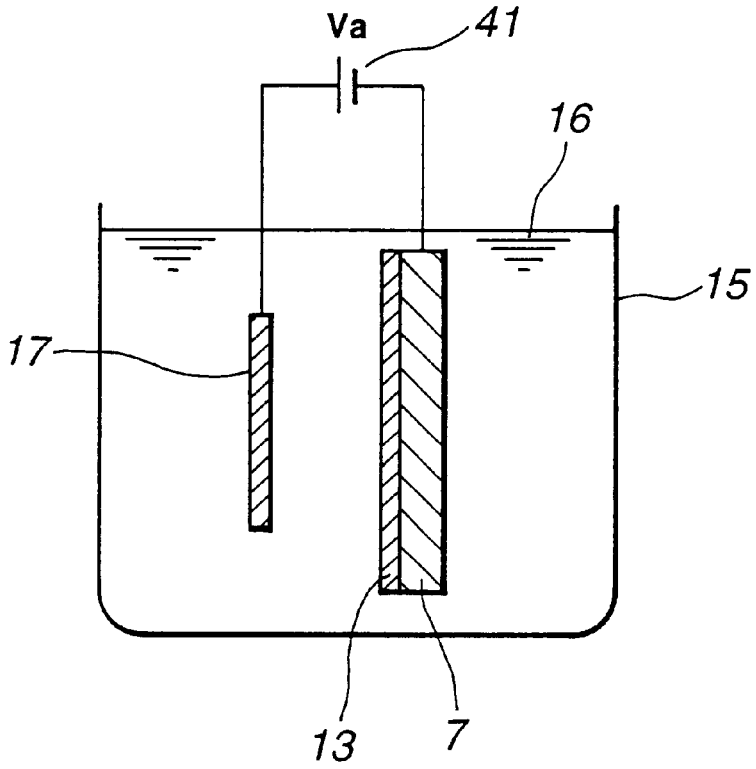
FIG. 6 schematically shows an apparatus used for anode oxidization.
Figure 7:
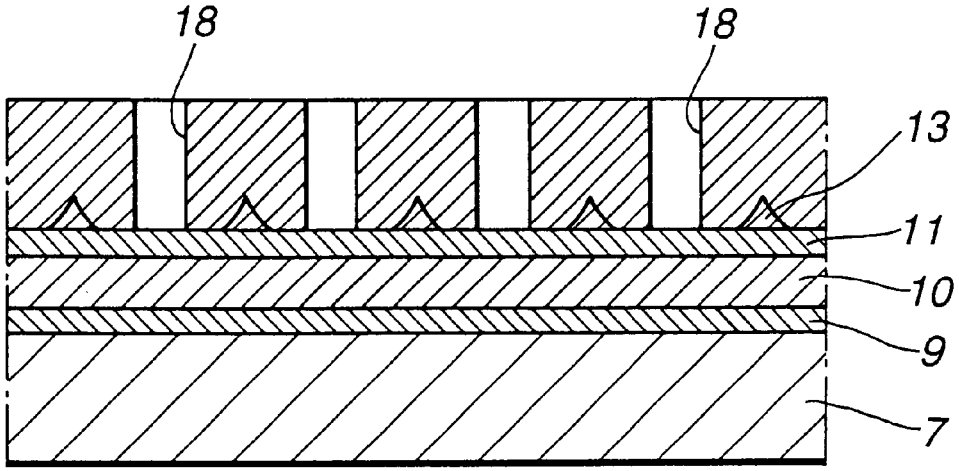
FIG. 7 is a cross sectional view showing a portion containing a mask layer formed by the electron emission device production method according to the present invention.

Next, as shown in FIG. 6, the conductive film 13 formed at the intersection of the cathode electrode and the gate electrode 11 is subjected to an anode oxidation. This anode oxidization is carried out as follows. The conductive film 13 and an opposing electrode 17 arranged to oppose to the conductive film 13 are immersed in an acid solution 16 in a treatment vessel 15, and a positive voltage is applied to the gate electrode 11 whereas a negative voltage is applied to the opposing electrode 17. Thus, the conductive film 13 is subjected to the anode oxidation and as shown in FIG. 6. The result as shown in FIG. 7, is the formation of; porous mask layer 19 is formed with a plurality of holes 18. More specifically, when the conductive film 13 is an aluminium film, the anode oxidation forms an oxide film 17 of aluminium oxide with a plurality of holes 18 formed in this oxide film 19.

Here, if the conductive film 13 has been formed only at the intersections between the cathode electrode 9 and the gate electrode 11, a positive voltage applied to the gate electrode forms the holes 18 over the entire surface of the conductive film 13. In contrast to this, if the conductive film 13 has been formed over the entire surface of the insulation substrate, the conductive film 13 is preferably masked with an insulation material such as a photo-resist excluding the intersections between the cathode electrode 9 and the gate electrode 11. In this case, a positive voltage applied to the gate electrode 11 causes anode oxidation of only the exposed portion, i.e., the conductive film 13 formed at the intersections of the gate electrode 11 with the cathode electrode 9. Thus, the porous mask layer 19 is formed with a plurality of holes 18 only at the intersections between the gate electrode 11 and the cathode electrode 9.

Figure 8:
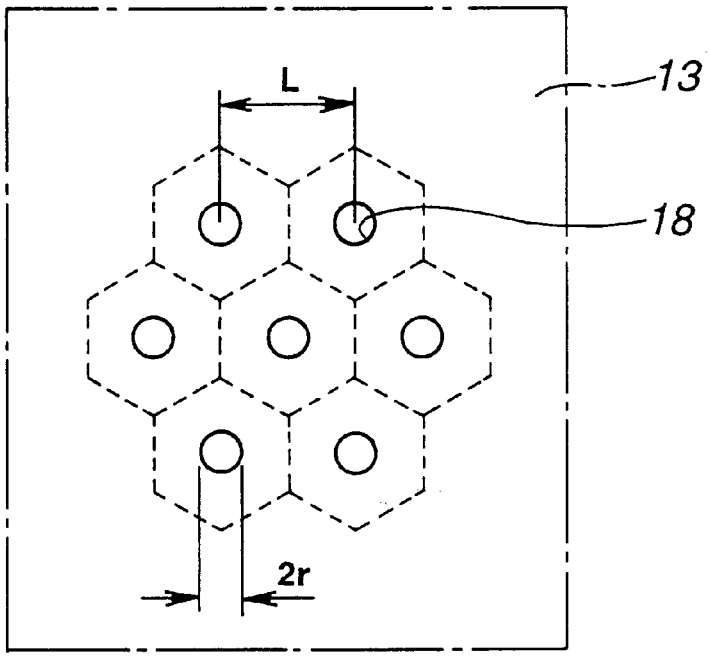
FIG. 8 is a plan view of a portion containing the mask layer.

Moreover, in this method, the anode oxidation forms a plurality of holes 18 having a radius r at an interval L. Here, as shown in FIG. 8, the holes 18 are arranged in such a manner that the surface of the conductive film 13 is filled with a plurality of hexagons and the holes 18 are positioned almost at the center of the respective hexagons. That is, the interval L of between two adjacent holes 18 is an interval between centers of these virtual hexagons.

Thus, the holes 18 are formed by the anode oxidation and accordingly, the radius r can be very small and the holes are formed approximately at an identical interval. That is, these holes have a radius r which is as small as 0.2 micrometers or less and there is no case that a plurality of holes are overlapped.

Furthermore, in this anode oxidation, by adjusting the voltage Va applied between the gate electrode 11 and the opposing electrode 17, it is possible to control the radius r of the holes and the interval L between the holes. More specifically, when the conductive film is made from aluminium, the relationship between the radius r and the interval L is approximately as follows: L=5.4 r. Moreover, the relationship between the voltage Va and the radius r can be expressed as r (nm=0.5 Va (V). Accordingly, the interval L and the voltage Va have a relationship expressed as L (nm)=2.7 Va (V). Thus, the radius r and the interval L have the aforementioned relationships with the voltage Va. Consequently, it is possible to obtain a desired r and desired L by adjusting the voltage Va.

Figure 9:
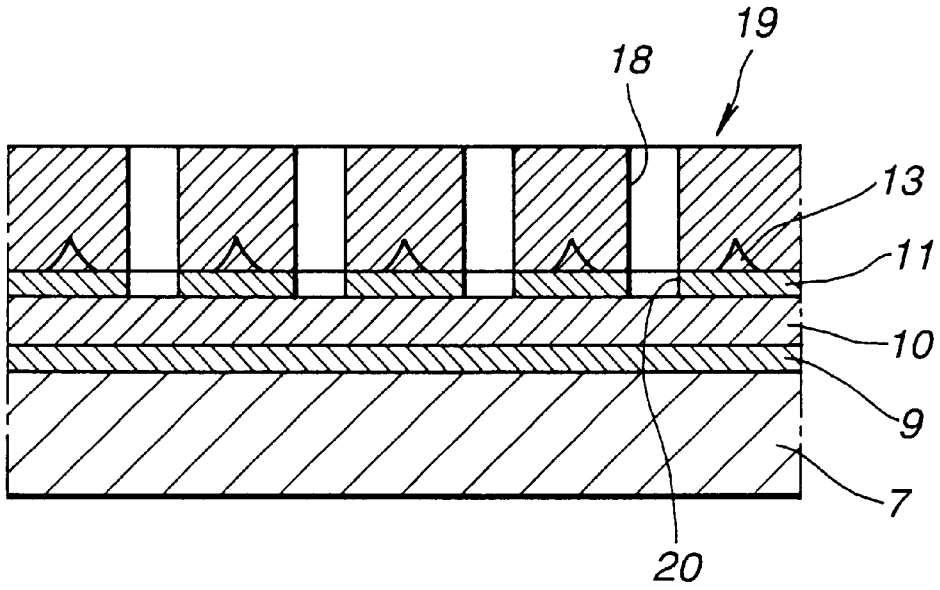
FIG. 9 is a cross sectional view showing a portion containing a first opening formed by the electron emission device production method according to the present invention.

Next, as shown in FIG. 9, the gate electrode 11 is formed using as a mask the layer 19 having the holes 18. Here, the first opening 20 is preferably formed by way of etching having anisotropy in the layering direction (hereinafter, referred to as anisotropic etching). With this anisotropic etching, it is possible to accurately transfer the configuration of the hole 18 to form the gate electrode 11, enabling to obtain a plurality of first openings 20 each having a radius r at an identical intervals L.

Figure 10:
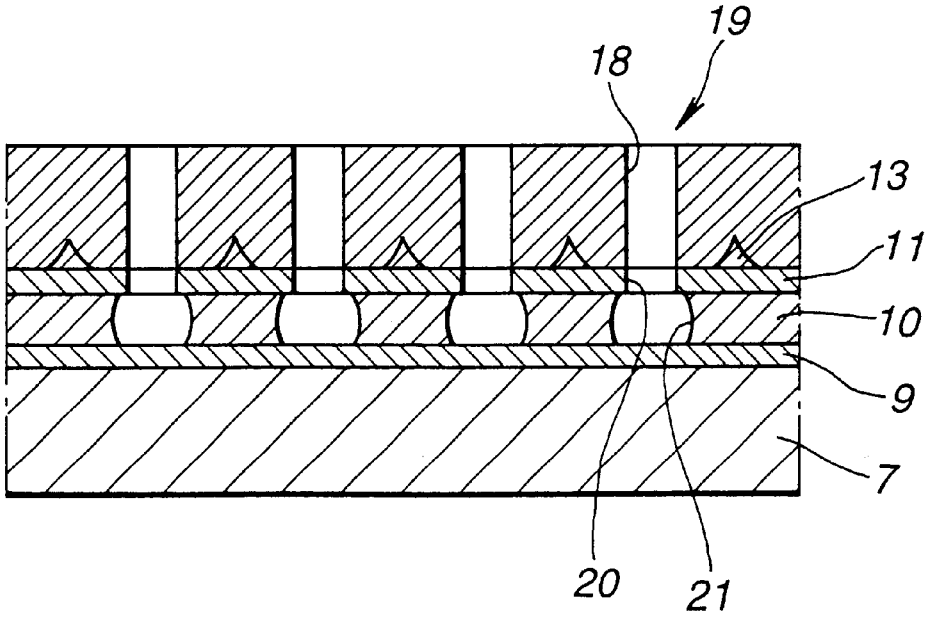
FIG. 10 is a cross sectional view showing a portion containing a second opening formed by the electron emission device production method according to the present invention.

Next, as shown in FIG. 10, the insulation layer 10 is formed using as a mask the layer 19, so as to form the second opening 21. Here, the second opening 21 is preferably formed by way of isotropic etching. With this isotropic etching, the second opening 21 has an opening end recessed from the opening end of the first opening 20. In other words, the second opening has a radius greater than the radius r of the first opening 20.

Figure 11:
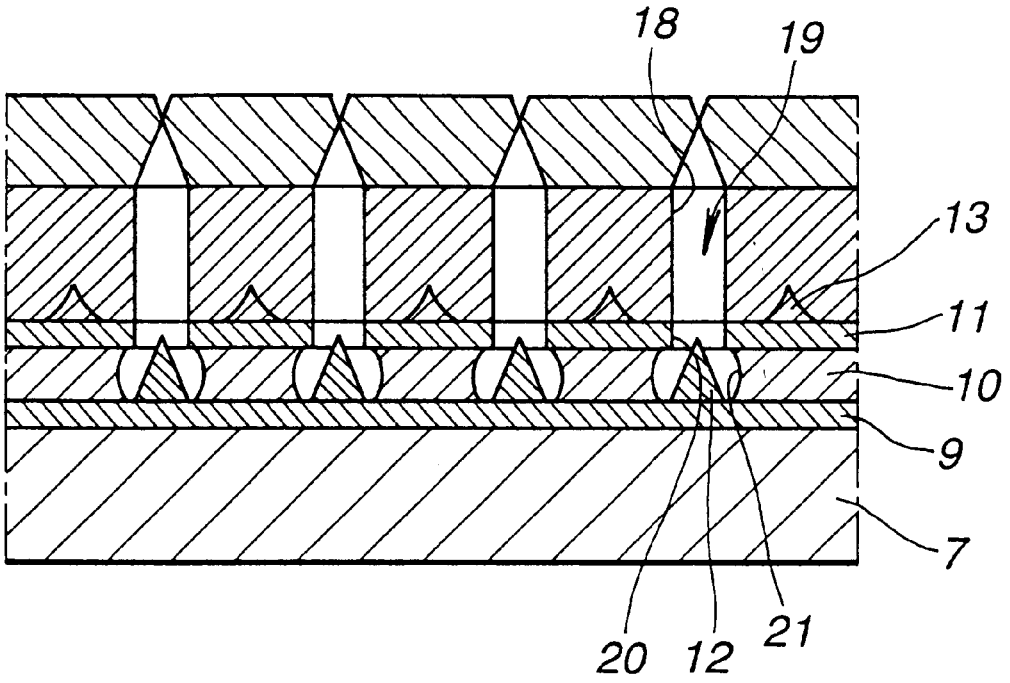
FIG. 11 is a cross sectional view showing a portion containing an emitter electrode formed by the electron emission device production method according to the present invention.

Next, as shown in FIG. 11, a conductive material or a semiconductor material is accumulated within the second opening 21 so as to form the emitter electrode 12. Here, the emitter electrode 12 is formed, for example, by using the vacuum deposition method or other accumulation method. It should be noted that the emitter electrode 12 here was formed from molybdenum (Mo) by way of the vacuum deposition method.

Here, the conductive material or the semiconductor material is deposited on the cathode electrode 9 exposed through the second opening 21 as well as on the layer 19. The conductive material or the semiconductive material is formed so as to gradually cover the hole 18 formed in the mask layer 19. Accordingly, the hole 18 of the mask layer 19 gradually reduces its opening area. Thus, in the second opening 21, the conductive material or the semiconductive material is accmulated according to the opening dimension of the hole 18. Consequently, the conductive material or the semiconductive material is accumulated in the opening 21 approximately in a conical shape.

Figure 12:
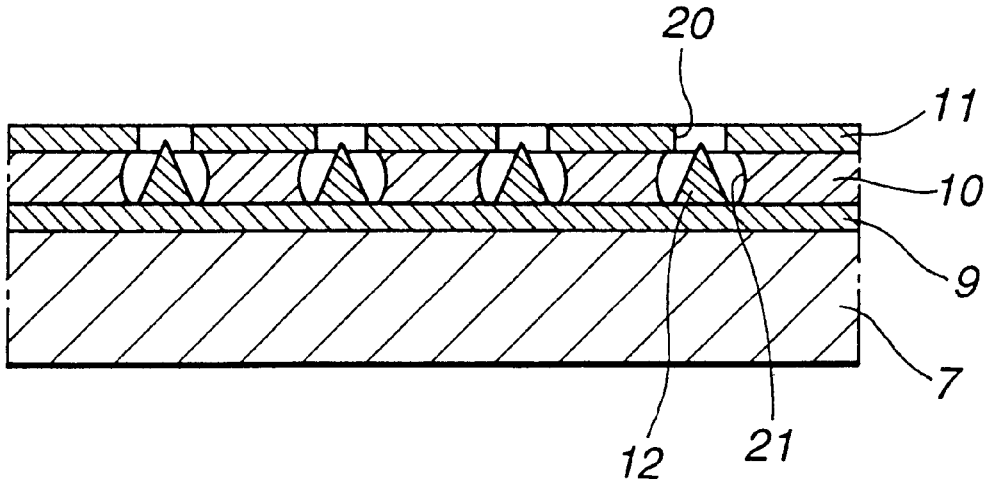
FIG. 12 is a cross sectional view showing a portion after removal of the sacrifice layer by the electron emission device production method according to the present invention.

Next, as shown in FIG. 12, the mask layer 19 is removed together with the conductive material or the semiconductive material on the mask layer 19. Here, the sacrifice layer 19 is removed using an acid solution such as phosphoric acid by way of wet etching. Thus, the mask layer 19 is removed together with the unnecessary conductive material or the semiconductive material, leaving only the conical emitter electrode 12 formed in the second opening 21 on the cathode electrode 9.

As has been described above, in this method, the porous layer 19 is formed by subjecting the conductive film 13 such as an aluminium film to the anode oxidation. By this anode oxidation, the conductive film 13 becomes a porous layer 19 having a number of holes 18 arranged regularly. Thus, the layer 19 is formed by anode oxidation of the conductive film 13 and accordingly, it is possible to obtain a plurality of holes arranged regularly without overlap and each having a small opening dimension.

Consequently, by carrying out the anisotropic etching of the gate electrodes 11 exposed through these holes, it is possible to form the first openings 20 arranged regularly without overlap and each having a very small opening dimension.

Thus, according to this method, it is possible to obtain a very small opening dimension of the first opening 20. Accordingly, it is possible to produce an electron emission device having a configuration in which an electric field generated from the gate electrode 11 is effectively concentrated at the tip end of the emitter electrode 12. Consequently, according to this method, it is possible to produce an electron emission device having a preferable electron emission characteristic compared to a conventional electron emission device without needing a high voltage applied to the gate electrode.

Moreover, according to this method, a plurality of first openings 20 can be formed approximately in a uniform manner over the plane of the gate electrodes 11 without overlap. Accordingly, as has been described above, a plurality of emitter electrodes 12 can be formed in a conical shape approximately in a uniform manner. Consequently, according to this method, a plurality of emitter electrodes 12 can have approximately identical electron emission characteristics. That is, according to this method, it is possible to easily form the emitter electrodes 12 having a stable electron emission characteristic.

The electron emission device production method according to the present invention is not limited to a case of forming the emitter electrodes 12 from a conductive or semiconductive material with the mask layer 19 left on the gate electrodes 11 as shown in FIG. 11.

That is, for example, it is possible to form the second openings 21 with the cathode electrodes 9 exposed as shown in FIG. 10, before removing the mask layer 19 on the gate electrodes 11 and forming the emitter electrode 12. It should be noted that in this case, as has been described above, the mask layer 19 formed on the gate electrodes can be removed by way of wet etching using an acid solution or the like.

Moreover, in this case, as has been described above, if the conductive material or the semiconductive material is accumulated to form the emitter electrodes 12, the conductive or the semiconductive material is also accumulated on the gate electrodes 11. In this case, the conductive or the semiconductive material accumulated on the gate electrodes 11 can be removed electro-chemically.

In this case also, as shown in FIG. 12, it is possible to form the first openings 20 each having a very small opening dimension without overlap. Accordingly, in this case also, it is possible to easily produce an electron emission device having an excellent electron emission characteristic.

The electron emission device production method according to the present invention is not limited to the aforementioned configuration. It is also possible to carry out the anode oxidation of the gate electrodes 11 so as to make porous a portion until a certain depth from the surface of the gate electrodes 11, so that this porous layer is used as a mask to form the first openings 20.

Figure 13:
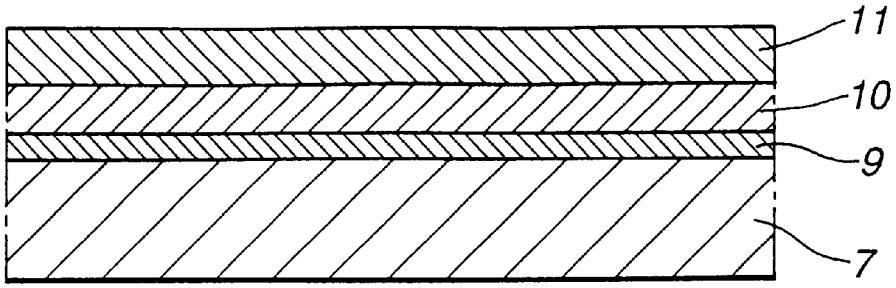
FIG. 13 is a cross sectional view showing an essential portion formed by an electron emission device production method according to another embodiment of the present invention.

That is, in this method, firstly, as shown in FIG. 13, similarly as in the case of FIG. 4, an insulation substrate 7 of glass or the like is prepared. On this insulation substrate 7, a plurality of cathode electrodes 9 are formed in a predetermined direction. The cathode electrodes 9 are covered by an insulation layer 10. Then, the gate electrodes 11 are formed in a direction vertically intersecting the cathode electrodes 9 on the insulation layer 10 on the insulation substrate 7. Here, the gate electrodes 11 are formed by a conductive film from aluminium or the like. More specifically, the gate electrodes 11 are made using an aluminium film having a thickness of 1.0 micrometer.

Next, similarly as in the aforementioned method, a positive voltage is applied to the gate electrodes 11 formed by the aluminium film, whereas a negative voltage is applied to the opposing electrodes, so as to carry out anode oxidation of the gate electrodes 11. Here, the anode oxidation was carried out only to a surface portion of the gate electrodes 11 and no anode oxidation was carried out to the side of the insulation layer 10. It should be noted that this anode oxidation oxidized the aluminium film to form the oxide aluminium film 25 having a high electrical resistance.

Figure 14:
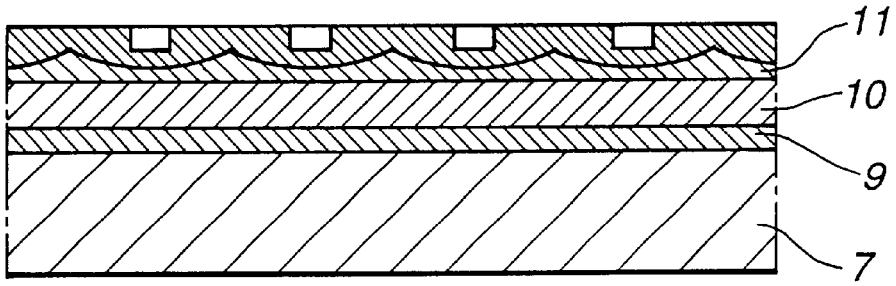
FIG. 14 is a cross sectional view showing an essential portion formed by an electron emission device production method according to still another embodiment of the present invention.

By this anode oxidation, a plurality of indentations 26 were formed as shown in FIG. 14, on the surface of the gate electrodes, i.e., in the oxide aluminium film 25. The indentations 26 were formed at the interval L, each with the radius r. Here, the indentations were formed with their respective centers at the positions of the centers of hexagons arranged to cover the entire surface of the electrodes. That is, the interval L of the indentations 26 was the interval of the centers of the hexagons.

Figure 15:
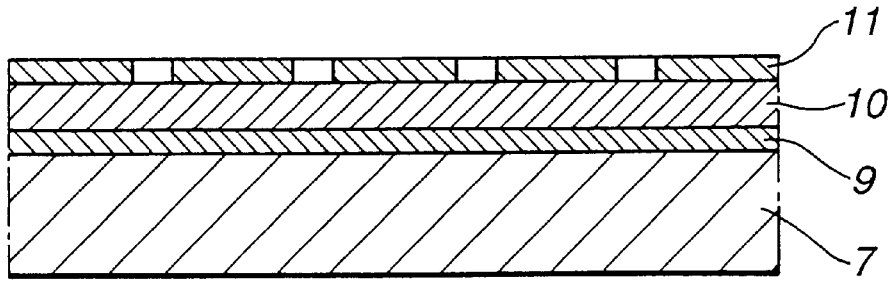
FIG. 15 is a cross sectional view showing an essential portion formed by an electron emission device production method according to yet another embodiment of the present invention.

Next, as shown in FIG. 15, the gate electrodes 11 having the plurality of indentations 26 were subjected to etching in the thickness direction, so as to expose the insulation layer 10 from the bottoms of the indentations 26. In other words, the oxide aluminium film 25 is etched in the thickness direction of the gate electrodes 11 until the insulation layer 10 is exposed from the bottoms of the indentations 26, thus forming the first openings 20. Here, the etching is preferably anisotropic etching having anisotropic characteristic in the thickness direction.

This anisotropic etching removes the oxide aluminium film 25 formed on the surface of the gate electrodes 11 almost completely. Accordingly, the gate electrodes 11 subjected to the anode oxidation will not have a high resistance and can be driven with a low voltage.

After the first openings 20 are formed, similarly as in the aforementioned method, the second openings 21 are formed, so as to expose the cathode electrodes 9 from the second openings 21, where the emitter electrodes 12 were formed, thus completing the electron emission devices.

In this method, it is possible to form a porous layer by way of the anode oxidation without forming the mask layer 19. Moreover, in this method, it is is possible to form the plurality of first openings 20 with a very small dimension and to arrange these first openings 20 regularly without overlap. Accordingly, this method enables the production of electron emission devices including gate electrodes 11 for applying an electric field to the emitter electrodes that have a stable electron emission characteristic.

Moreover, in this method, the first openings 20 are formed as a porous layer without forming the mask layer 19. Accordingly, in this method, it is possible to omit the step of forming the mask layer 19 and the step of removing the mask layer 19, enabling to simplify the production procedure.

The electron emission device production method according to the present invention is not limited to the aforementioned method applied when producing electron emission devices for use in the aforementioned FED, but can be applied even when producing electron emission devices for use in other types of display devices.

Moreover, the electron emission devices produced by the present method can be used not only for the aforementioned FED or other display apparatuses but also in a vacuum tube, a circuit element, and the like.

When the electron emission device is used in a vacuum tube, the electron emission device is used as an electron tube for controlling electrons emitted from the emitter electrode for amplification or rectification. Here, the gate electrode serves as a so-called grid.

Moreover, when the electron emission device is used in a circuit element, the electron emission device includes a fluorescent plane at an opposing position for example, and an electron conversion element is attached to this fluorescent body, so that electrons are emitted toward the fluorescent plane in the same way as in the aforementioned FED. In this circuit element, electrons emitted from the electron emission device strike the fluorescent plane so that the fluorescent plane emits light. In this circuit element, the light emission pattern on the fluorescent plane is detected by the photoelectric conversion element so that electrons emitted from the electron emission device are taken out as a signal current.

In these cases also, using the aforementioned methods, it is possible to produce an electron emission device including a gate electrode for effectively applying an electric field to the emitter electrode that exhibits a stable electron emission characteristic. Accordingly, in these cases also, the present invention enables production of a vacuum tube and a circuit element which can be preferably driven by a low voltage.

As has been described above, the electron emission device production method according to the present invention forms the first openings using as a mask the porous layer having a plurality of holes reaching the conductive layer. Accordingly, the first openings have an almost identical shape as the holes of the porous layer and can be formed with very small dimensions that are arranged regularly without any overlap. Consequently, this method enables the formation of the first openings capable of applying a predetermined electric field to the emitter electrodes 12 and formation of emitter electrodes having an excellent electron emission characteristic.

Moreover, according to another aspect of the present invention, there is provided an electron emission device production method in which a conductive layer is subjected to anode oxidation to make porous a surface portion of the conductive layer in the thickness direction, which can be used as a mask to form the first openings in the thickness direction of the conductive layer. Accordingly, the first openings have an almost identical shape as the holes of the porous layer, enabling openings having very small dimensions and arranged regularly without overlap. Consequently, this method enables to formation of first openings capable of preferaby applying a predetermined voltage to the emitter electrodes 12 and to formation emitter electrodes having an excellent electron emission characteristic.

What is claimed is:

1. An electron emission device production method comprising steps of:

forming a gate electrode layer over an insulation layer which is formed over a cathode electrode on a substrate;

forming a conductive mask layer over said gate electrode layer;

forming a plurality of openings in said conductive mask layer by anode oxidation of said conductive mask layer;

forming a plurality of first openings in said gate electrode layer using said mask layer;

forming a plurality of second openings through said insulation layer, wherein each of said second openings communicates with one of said first opening so as to expose said cathode electrode; and forming emitter electrodes on said cathode electrode in said second openings.

2. An electron emission device production method as claimed in claim 1, wherein said anode oxidation is carried out by placing said substrate in an acid solution with said conductive mask layer opposite an opposing electrode.

3. An electron emission device production method as claimed in claim 1, wherein said conductive mask layer is made from aluminum as a main content.

4. An electron emission device production method as claimed in claim 1, wherein said plurality of first openings are formed by anisotropic etching of said gate electrode layer.

5. An electron emission device production method as claimed in claim 1, wherein said plurality of second openings are formed by isotropic etching of said insulation layer.

6. An electron emission device production method as claimed in claim 1, wherein said emitter electrodes are formed by depositing a thin film of a conductive material using said mask layer and said first and second openings as a mask.

7. An electron emission device production method as claimed in claim 1, wherein said cathode electrode and said gate electrode layer are formed as regularly spaced strips, the strips of said cathode electrode being perpendicular to the strips of said gate electrode layer.

8. An electron emission device production method as claimed in claim 2, further comprising applying a positive voltage to said gate electrode layer and a negative voltage to said opposing electrodes.

9. An electron emission device production method as claimed in claim 2, further comprising controlling a radius and spacing of said openings in said mask layer with a voltage difference between said gate electrode layer and said opposing electrode.

10. An electron emission device production method as claimed in claim 1, wherein said forming a plurality of second openings includes forming said plurality of second openings with a radius greater than a radius of said first openings.

11. An electron emission device production method as claimed in claim 1, further comprising removing said mask layer.

12. An electron emission device production method comprising steps of:

forming a gate electrode layer over an insulation layer which is formed over a cathode electrode on a substrate;

forming a plurality of indentations in said gate electrode layer by anode oxidation;

forming a plurality of first openings through said gate electrode layer corresponding to said plurality of indentations;

using said gate electrode layer as a mask, forming a plurality of second openings through said insulation layer, wherein each of said second openings communicates with one of said first opening so as to expose said cathode electrode; and forming emitter electrodes on said cathode electrode in said second openings.

13. An electron emission device production method as claimed in claim 12, wherein said anode oxidation is carried out by placing said substrate in an acid solution with said gate electrode layer opposite an opposing electrode.

14. An electron emission device production method as claimed in claim 12, wherein said gate electrode layer is made using aluminum.

15. An electron emission device production method as claimed in claim 12, wherein said plurality of first openings are formed by anisotropic etching of said gate electrode layer.

16. An electron emission device production method as claimed in claim 12, wherein said plurality of second openings are formed by isotropic etching of said insulation layer.

17. An electron emission device production method as claimed in claim 12, wherein said emitter electrodes are formed by depositing a thin film of a conductive material using said first and second openings as a mask.

18. An electron emission device production method as claimed in claim 12, wherein said cathode electrode and said gate electrode layer are formed as regularly spaced strips, the strips of said cathode electrode being perpendicular to the strips of said gate electrode layer.

19. An electron emission device production method as claimed in claim 13, further comprising applying a positive voltage to said gate electrode layer and a negative voltage to said opposing electrode.

20. An electron emission device production method as claimed in claim 13, further comprising controlling a radius and spacing of said openings in said mask layer with a voltage difference between said gate electrode layer and said opposing electrode.

21. An electron emission device production method as claimed in claim 12, wherein said forming a plurality of second openings includes forming said plurality of second openings with a radius greater than a radius of said first openings.

22. An electron emission device production method comprising steps of:

forming a gate electrode layer over an insulation layer which is formed over a cathode electrode on a substrate;

forming a conductive mask layer over said gate electrode layer with a plurality of openings therein;

forming a plurality of first openings by anode oxidation in said gate electrode layer using said mask layer;

forming a plurality of second openings through said insulation layer, wherein each of said second openings communicates with one of said first opening so as to expose said cathode electrode; and forming emitter electrodes on said cathode electrode in said second openings.

* * * * *